US006562100B2

(12) United States Patent
Takizawa et al.

(10) Patent No.: US 6,562,100 B2
(45) Date of Patent: May 13, 2003

(54) MATERIAL SUPPLY AND MELTING METHOD IN INJECTION MOLDING OF METAL MATERIAL

(75) Inventors: Kiyoto Takizawa, Nagano-ken (JP); Toshiyasu Koda, Nagano-ken (JP); Yuji Hayashi, Nagano-ken (JP); Mamoru Miyagawa, Nagano-ken (JP)

(73) Assignee: Nissei Plastic Industrial Co., Ltd., Nagano-Ken (JP)

( * ) Notice: Subject to any disclaimer, the term of this patent is extended or adjusted under 35 U.S.C. 154(b) by 0 days.

(21) Appl. No.: 09/924,864

(22) Filed: Aug. 8, 2001

(65) Prior Publication Data

US 2002/0020947 A1 Feb. 21, 2002

(30) Foreign Application Priority Data

Aug. 9, 2000 (JP) ..... 2000-241429

(51) Int. Cl.[7] ..... B22D 13/00

(52) U.S. Cl. ..... 75/386; 222/590; 164/113; 164/312; 164/590

(58) Field of Search ..... 222/590; 75/386; 164/113, 312, 900

(56) References Cited

U.S. PATENT DOCUMENTS 6,405,784 B2 * 6/2002 Takizawa et al. ..... 164/113

* cited by examiner

*Primary Examiner*—Melvyn Andrews
(74) *Attorney, Agent, or Firm*—Weingarten, Schurgin, Gagnebin & Lebovici LLP

(57) ABSTRACT

The invention has an object to permit to make the accumulation amount and the temperature of molten metal in the metal material molding machine constant, by performing material supply and melting taking the accumulation amount as reference during the molding operation. The supply apparatus 11 and the agitation means 29 of metal material at the moment of operation starting are controlled to be inactive until the temperature of the melting vessel attains a predetermined value and to start operating when the predetermined temperature is attained, allowing to supply and agitate the metal material. The supply and the agitation of metal material after the predetermined temperature is attained, are performed while gradually supplying and agitating the metal material until metal material of at least 6 times or more of the maximum injection volume is accumulated in melt state.

4 Claims, 3 Drawing Sheets

MATERIAL SUPPLY AND MELTING METHOD IN INJECTION MOLDING OF METAL MATERIAL

BACKGROUND OF THE INVENTION

1. Field of the Invention

The present invention concerns a material supply and melting method in the case of molding by injection molding low melting point metal molds of zinc, magnesium or their alloy or the like with low melting point.

2. Detailed Description of the Prior Art

Die cast is adopted for casting nonferrous metals of low fusion point, die cast requires a smelter for melting metal material completely, and the casting is executed by drawing molten metal from this smelter or extruding by a plunger. The dipping of molten metal for molding is dangerous, and the extrusion molding by plunger of the prior art presents problem of low weighing accuracy of molten metal; therefore, the Inventors have developed a molding machine capable of molding high quality metal products under an safe operation, by injection filling of a mold with weighed molten metal, similarly as plastic material injection molding.

This novel metal material molding machine is composed to nozzle-touch a nozzle member of the nozzle-touch block front to a die of a die squeeze mechanism, to nozzle-touch a nozzle portion at the extremity of a melting vessel composing the body of an injection mechanism to this nozzle-touch block, to weigh metal material in the melting vessel, molten by an external heat, by retrogression of an internal injection plunger, and to fill the die by injection from the nozzle member, trough a hot runner in the nozzle-touch block, by forward movement of this injection plunger.

It is necessary to maintain the accumulation amount and the temperature of molten metal constant, in order to obtain metal molds of stable quality by such a molding machine; therefore, it must be able to control the supply amount of metal material to an amount corresponding to the accumulated amount and, if the accumulated amount is insufficient, to maintain the accumulation amount and the temperature constant, by compensating immediately without being limited by the progress of molding process.

The present invention, devised considering the situation mentioned above, has an object of providing a material supply and melting method in injection molding of molten metal, allowing to maintain the accumulation amount and the temperature of molten metal constant all the times, by taking the temperature as reference when the operation starts, and the accumulated amount as reference during the molding operation.

SUMMARY OF THE INVENTION

In order to attain this object, the present invention is a method for supplying granular metal material from a supply apparatus into a cylindrical melting vessel having on the extremity thereof a weighing chamber communicating with a nozzle member and a rotatable agitation means inside and an injection means formed into an injection plunger on the extremity portion thereof and being inserted advanceably and retractably into a center portion of the agitation means, said injection plunger being slidably engaged with the weighing chamber, comprising the steps of: melting the metal material by an external heat, accumulating, weighing, then injecting and charging into a mold by the injection means to mold a metal mold, wherein the supply apparatus and the agitation means of metal material at the moment of operation starting are controlled to be inactive until the temperature of the melting vessel attains a predetermined value and to start operating when the predetermined temperature is attained, allowing to supply and agitate the metal material, and the supply apparatus and the agitation of metal material after the predetermined temperature is attained, are performed by gradually supplying and agitating, until metal material of at least 6 times or more of the maximum injection volume is accumulated in melt state.

Moreover, the invention is a method, wherein the speed and the time of the supply apparatus are controlled so that the supply of the metal material during the molding operation starts after the weighing completion in the duration of the operation of the agitation of molten metal in the melting vessel by the agitation means and stops the metal material for one shot of mold including spool, runner or others before starting the following weighing, for maintaining the accumulation amount and the temperature of molten metal in the melting vessel constant all the times.

Further, the invention is a method, wherein the supply apparatus is controlled so that the supply of the metal material during the molding operation starts when the molten metal surface level is lowered to the lower limit of the predetermined level value, by monitoring and detecting the variation of the molten metal surface level by a liquid level sensor in the duration of the operation of the agitation of molten metal accumulated in the melting vessel by the agitation means, and stops when the upper limits is attained, for maintaining the accumulation amount and the temperature of molten metal in the melting vessel constant all the times.

DETAILED DESCRIPTION OF THE PREFERRED EMBODIMENT

Figure 1:
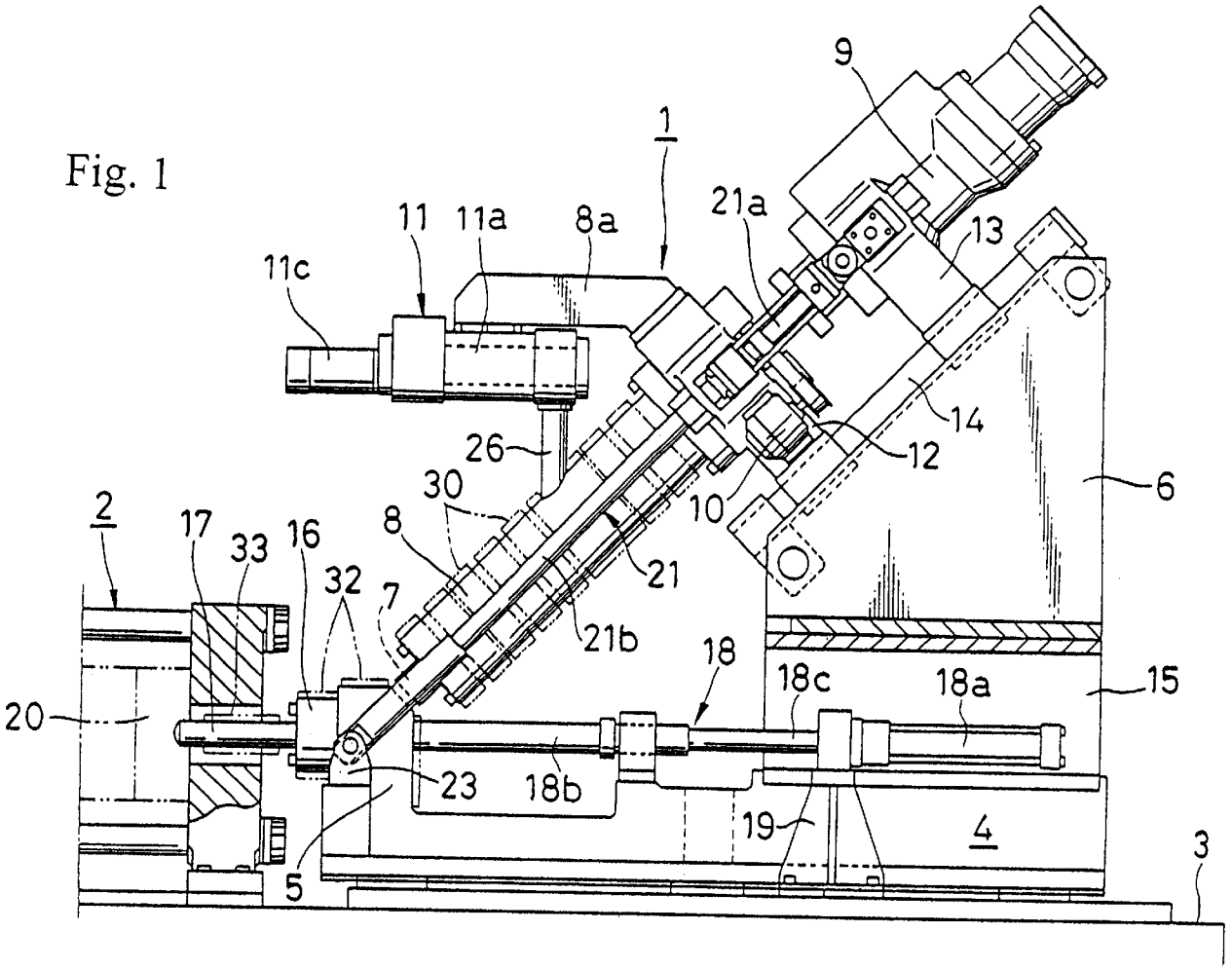
FIG. 1 is a partial longitudinal section view of a metal material molding machine capable of metal material injection molding by adopting the material melting method according to the present invention.

The drawing shows one embodiment of a metal material molding machine adopting the material melting method according to the invention.

In the drawing, 1 is an injection mechanism, and 2 is a squeeze mechanism, both mounted on a top face of a base 3.

4 is a pedestal installed movably forward and backward in respect of the squeeze mechanism 2 and provided with a nozzle touch block 5 affixed on the front portion and a trestle 6 having a top face formed into an inward slant surface of an angle of around 45° mounted on the rear portion thereof, and the injection mechanism 1 is installed movably forward and backward through the bearing on this slant top face of this trestle 6 so that a nozzle portion 7 of the extremity thereof is positioned downward in respect of the squeeze mechanism.

The injection mechanism 1 comprises a melting cylinder 8 constituting the metal material melting vessel, an injection cylinder 9 linked to the rear end portion thereof by a tie bar with an interval, a regular and reverse rotatable electric motor 10, for agitation, mounted under the rear end of the melting cylinder 8, and a supply apparatus 11 for supplying granular metal material in the melting cylinder, and ends of support legs 12, 13 protruding downward at both side of this melting cylinder 8 and the injection cylinder 9 are slidably inserted into a support shaft 14 on the slant top face of the trestle 6 whose top face is formed into an inward slant surface of an angle of around 45°, to install on a slant to the squeeze mechanism 2.

The trestle 6 is, though not illustrated, placed and fixed to a gate form seat 15 installed on the rear end portion of the pedestal 4, and a nozzle-touch apparatus 18 of a nozzle member 17 provided horizontally by a member 16 at the front of the nozzle-touch block is arranged from the inside middle of this seat 15 to the nozzle-touch block 5.

This nozzle-touch apparatus 18 comprises an hydraulic cylinder 18*a* and a rod member 18*b* connected to a piston rod 18*c*, this hydraulic cylinder 18*a* is anchored to a reception member 19 installed in a longitudinal hollow space (not shown) at the middle of the pedestal 4 by affixing to the base top face, while the rod member 18*b* is linked to the rear face of the nozzle-touch block 5 and moves the pedestal 4 forward and back with the injection mechanism 1 and the nozzle-touch block 5, by the back and forward movement of the hydraulic cylinder 18*a*, allowing the nozzle-touch and separation between the nozzle member 17 of the front face of the nozzle-touch block 5, and the die 20 of the squeeze mechanism 2.

Figure 2:
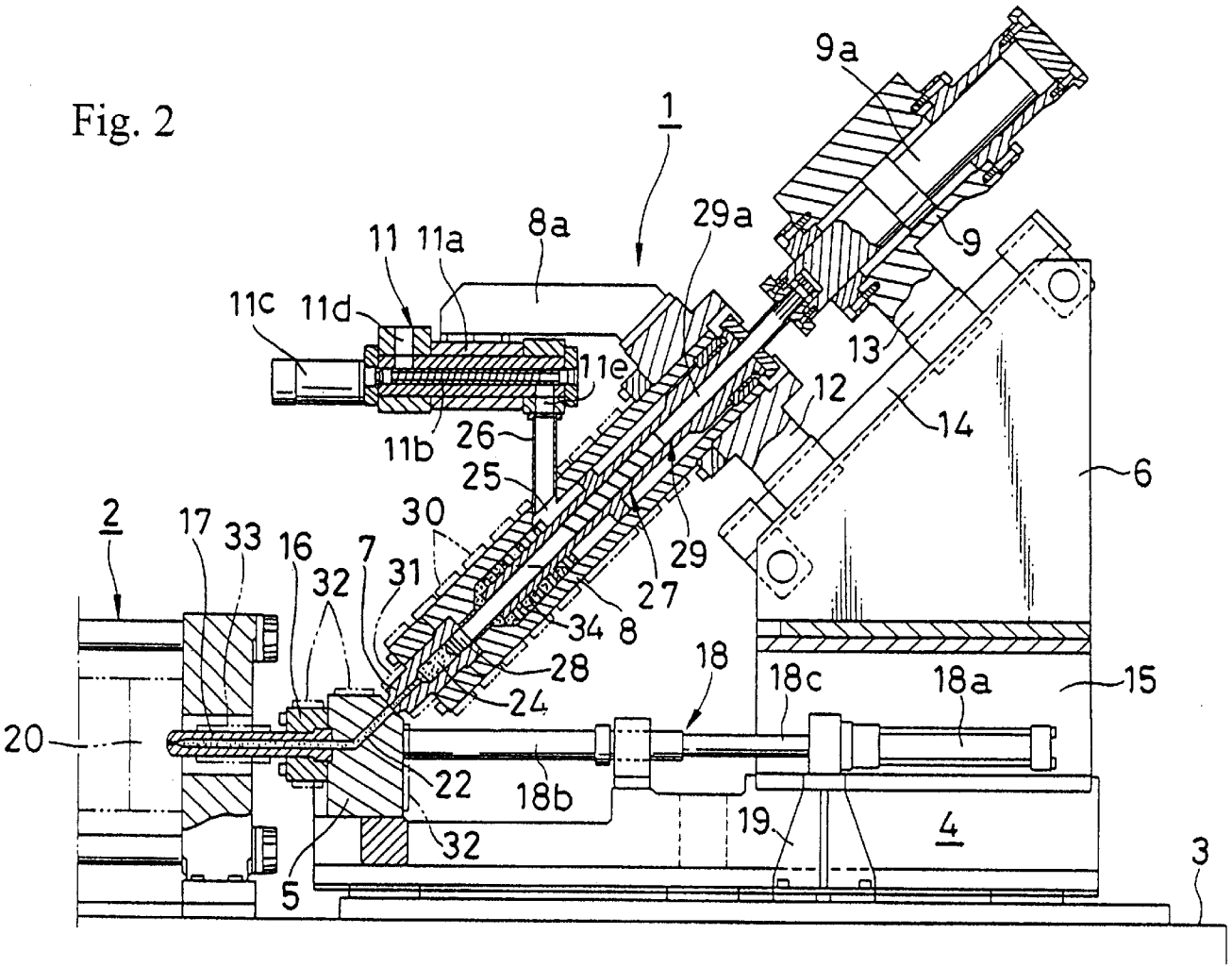
FIG. 2 is a longitudinal section view of the same.

As shown in FIG. 2, a hot runner 22 communicating with the nozzle member 17 and the nozzle portion 7 of the injection mechanism 1 is formed in a bent condition on the interior of the nozzle-touch block 5. The rear face upper part is formed on the slant rear face positioned perpendicularly to the axial line of the nozzle portion 7 of the injection mechanism 1, and the open end of the hot runner 22 is perforated on this slant rear face as gate for nozzle-touch. This allows a close nozzle-touch with the nozzle-touch block 5, by a nozzle-touch apparatus 21 juxtaposed at both sides of the injection mechanism 1, even if the nozzle portion 7 is on a slant, permitting to flow molten metal from the nozzle portion 7 smoothly to the nozzle member 7 and to fill the nozzle-touched die 20 by injection with no leak.

The nozzle-touch apparatus 21 comprises a hydraulic cylinder 21*a* bridged between the rear end of the melting cylinder 8 and the front end of the injection cylinder 9, and comprises a hydraulic cylinder 21*a* rotatavely affixed in the rear end thereof to the injection cylinder 9 and an elongated axial rod 21*b*, and is linked to the nozzle-touch block 5 by fixing the extremity of this rod 21*b* by a pin to a bearing member 23 installed upward at both sides of the nozzle-touch block 5. This allows the injection mechanism 1 on the trestle 6 to nozzle-touch, by moving forward and backward in respect to the slant rear face of the nozzle-touch block 5 in a slant state. It is used also as retraction apparatus during repair or maintenance of the injection mechanism 1.

The interior of the extremity of the melting cylinder 8 of the injection mechanism 1 is formed into a weighing chamber of a required length having a diameter smaller than the inner diameter of the melting cylinder inner. A supply inlet is opened upside, and the supply apparatus 11 is held by a holder 8*a* fixed to the melting cylinder 8 and connected to a supply tube 27 erected at this supply inlet 25.

An agitation means 27 composed of a hollow rotation shaft provided with several lines of agitation fin formed discontinuously around the outer periphery of the extremity portion, and an advanceable and retractable injection means 29 inserting an injection plunger 28 at the extremity of a rod 29*a* passing through this agitation means 27 into the weighing chamber 24, and linking the rod rear end to the piston rod 9*a* of the injection cylinder 9 are provided in the interior of this melting cylinder 8.

A timing belt 10*a* is suspended across the rear end portion protruding from the open end of the melting cylinder 8 and a driving shaft of the electric motor 10, to be rotated and yawed by this electric motor 10.

Heaters 30, 31, 32, 33 such as band heater capable of individual temperature control, are disposed on the outside face of the melting cylinder 8 and the nozzle portion 7, the nozzle-touch block 5 and the nozzle member 17, allowing to heat to a temperature around the liquidus temperature (called, predetermined temperature, hereinafter).

As shown in FIG. 2, the supply apparatus 11 comprising a screw conveyer 11*b* in a horizontal cylinder 11*a*, has a structure for transporting granular metal material to a delivery port lie under the cylinder front, from the input port lid above the cylinder rear portion, by turning this screw conveyer 11*b* by an electric motor 11*c* at the cylinder rear end and, for supplying metal material to the interior of the melting cylinder 8 from the supply tube 26 connected to this delivery port 11*e*.

The rotating speed of the screw conveyer 11*b* can be controlled by the electric motor 11*c*, thereby, allowing to change the supply time arbitrarily.

Though not illustrated, heaters for material preheating may be attached as necessary, around the cylinder 11*a*.

Next, as for a metal material molding machine of the composition, the material melting method of the invention will be described in detail, taking the molding of magnesium alloy as example of metal material.

First, before starting the molding operation, in a state wherein nozzle-touch is not performed by retracting the nozzle-touch apparatus 18, 21, the temperature in the melting cylinder 8 is elevated to a predetermined temperature (of the order of 580° C.), to avoid inconveniences during the nozzle touch due to thermal dilatation, but the nozzle-touch block 5, the nozzle 7 and the nozzle member 17 is heated to the nozzle-touch temperature (500° C.).

When the temperature of the nozzle-touch block 5, nozzle portion 7 and nozzle member 17 attains the nozzle-touch temperature, the nozzle-touch apparatus 21 is operated to advance, to nozzle-touch the nozzle portion 7 with the nozzle-touch block 5, and the temperature control is changed from the nozzle-touch temperature to the predetermined temperature.

In this nozzle-touch state, the supply apparatus 11 and agitation means 27 controlled to an inactive state until the temperature of the melting cylinder 8 attains the predetermined temperature, are driven by revolution of the electric motor 11*c*, 10, to start the supply of granular material into the melting cylinder 8 and the agitation of heat molten metal material in the melting cylinder 8 by the heater 30.

During this heat melting of metal material, in order to prevent metal oxides from generating by reducing the oxygen concentration in the melting cylinder 8, though not illustrated, inactive gas such as argon is pressure-injected into the interior of the melting cylinder 8 from the supply port 25, making an inactive atmosphere in the melting cylinder 8.

Moreover, the supply of metal material is performed during gradually agitating molten metal material, until the metal material is accumulated to the order of 6 times to 20 times (the more the better) of the maximum injection volume in molten state as set quantity, the motor 11*c* is stopped when the predetermined accumulation amount is attained to suspend the supply, and only the agitation by the electric motor 10 is continued to maintain the temperature of the molten metal 34 uniform. This agitation is performed by rotation or yaw of the agitation means 27.

The accumulation amount of the molten metal 34 is detected by adopting a sensor for detecting the level of the molten metal surface in the melting cylinder 8. As for this sensor, a photoelectric sensor for detecting the level of the molten metal surface by irradiating light to the molten metal surface, and detecting the reflection light thereof, a conduction sensor for inserting an electrode directly in the molten metal, and detecting the presence/absence of contact between the electrode and the molten metal or others can be employed.

When it is confirmed that the accumulation quantity has attained the set quantity and the temperature of the each portion in nozzle-touch state is maintained to the set temperature of 580° C., the process changes over to the molding operation under the automatic control, and the material supply and the melting are also changed to the control aiming at a single molding cycle.

Figure 3:
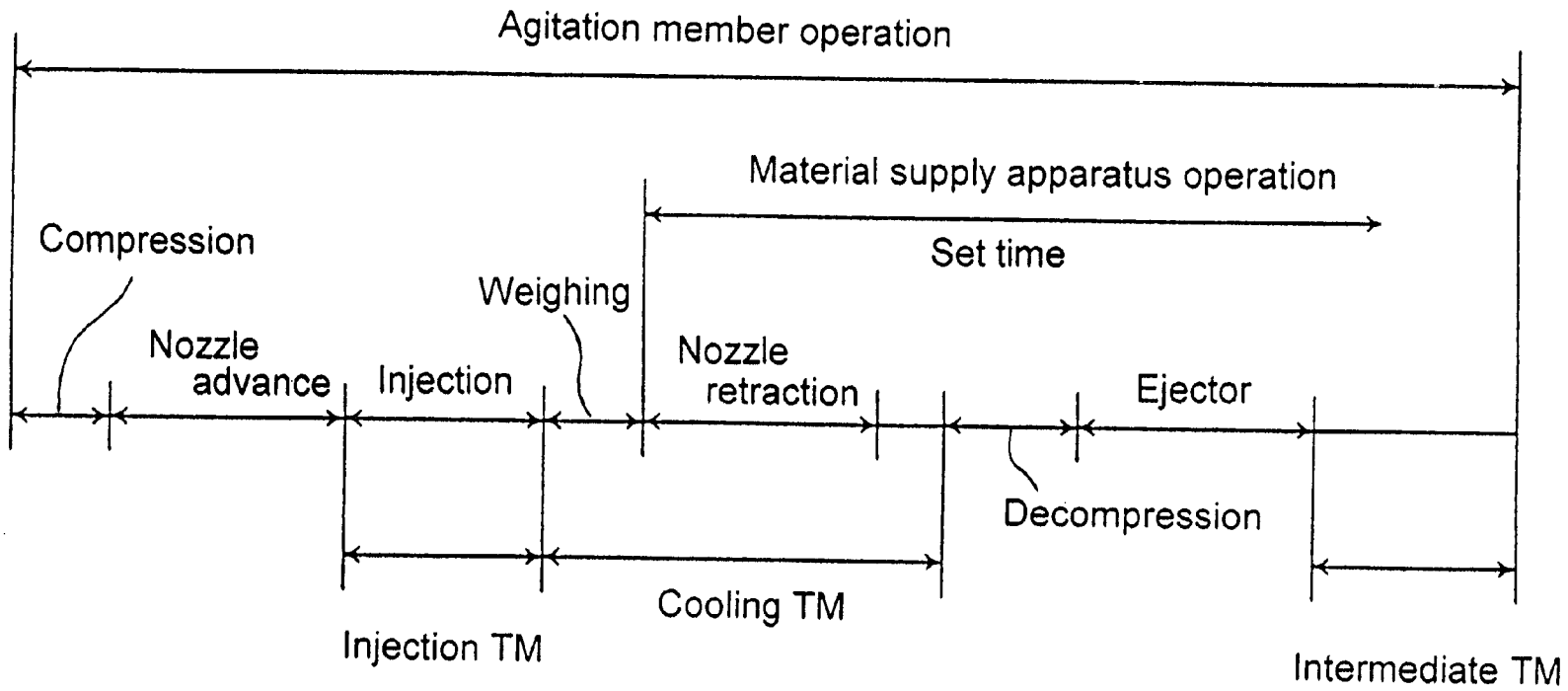
FIG. 3 a sequential diagram of a single molding cycle.

FIG. 3 shows the sequence of a single molding cycle in a state when the agitation operation is started after the accumulation of the material.

First, the die 20 is fastened by the squeeze mechanism 2. Next, in the injection mechanism 1, the nozzle-touch apparatus 18 advances to perform the nozzle-touch of the nozzle member 17 with the die 20. Before this nozzle-touch, the injection means 29 is retracted with the injection plunger 28 of the weighing chamber 24, and a part of molten metal 34 accumulated in the melting cylinder 8 is weighed in the weighing chamber 24.

When the nozzle-touch is confirmed by a proximity switch or the like, the process shifts to the injection, the piton rod 9*a* advances by the operation of the injection cylinder 9, the injection means 29 moves forward with the injection plunger 28 of the weighing chamber 24 to injection fill the die 20 from the nozzle member 17 with molten metal weighed in the weighing chamber 24, from the nozzle portion 7 through the hot runner 22 of the nozzle-touch block 5. After the end of filling, the pressure is maintained for injection time up.

Upon this injection time up, the process is changed over to the weighing, the piston rod 9*a* of the injection cylinder 9 operates the regression, the injection means moves backward, and moves backward the injection plunger 28 at the advanced position to the rear section of the weighing chamber 24.

This backward shift of the injection plunger 28 generates a negative pressure in the weighing chamber 24. This is because the molten metal in the nozzle port of the nozzle member 17 is cooled after the injection by the nozzle-touch with the die 20 to remain in the nozzle port as clod plug, and closes hermetically the nozzle side of the weighing chamber 24, preventing air from entering from the nozzle port.

In this state, if a backward force is applied to the injection plunger 28 in the forward position, a part of molten metal 34 accumulated in the melting cylinder 8 by suction effect of the negative pressure, flows by force into the weighing chamber 24 from the sliding clearance around the injection plunger, and weighed.

When the injection plunger 28 moves backward to a set position, the injection cylinder 9 stops to operate and the weighing ends. Following this, the nozzle-touch apparatus 18 moves backward, and the nozzle member 17 is detached from the die 20.

Almost at the same time, the electric motor 11*a* of the supply apparatus 11 rotates, starting to supply metal material for one shot of mold including spool, runner or others.

This supply is performed by controlling the rotation speed and the time of the electric motor 11*c* to be terminated before starting to weigh for the following injection molding, and the accumulation amount of molten metal in the melting cylinder 8 is maintained to the set quantity, by supplying metal material for one shot always before weighing, and it is also intended to maintain the temperature fixed under the agitation. In the squeeze mechanism 2, the die 20 is cooled down, to decompress after the cooling time up, and to take out (ejector) a metal mold (not shown).

Moreover, during the molding operation, if the molten metal surface level monitored by the liquid lever sensor varies downward to the lower limit of the level set value for some reason, the electric motor 11*c* of the supply apparatus 11 rotates, starting to supply metal, and stops rotating when the molten metal surface attains the upper limit of the level set value by this. This allows to maintain the accumulation amount of molten metal 34 always constant, and to stabilize the quality of injection molded metal molds.

What is claimed is:

1. For use with an injection mold having a maxium injection volume for said mold, a material supply and melting method for use in injection molding of metal material and for supplying granular metal material from a supply apparatus into a cylindrical melting vessel, said vessel provided with: a weighing chamber communicating with a nozzle member in an extremity thereof; a rotatable agitation means inside; and an injection means having an injection plunger, on the extremity portion thereof, inserted advanceably and retractably into a center portion of the agitation means, said injection plunger being slidably engaged with the weighing chamber, said method comprising the steps of:

melting the metal material by an external heat to form melted metal;

accumulating in melted state at least 6 times the maximum injection volume for said mold;

weighing, then injecting and charging the metal material into a mold by said injection means to mold a metal article; wherein the supply apparatus and agitation means are controlled to be inactive until (1) a temperature of said melting vessel attains a predetermined value sufficient to melt said metal and (2) said at least 6 times the maximum injection volume is accumulated in melted state; and to start operating when the predetermined temperature is attained, allowing for supply of said melted metal material; and the supply of metal material after the predetermined temperature is attained is performed while gradually supplying and agitating, maintaining metal material of at least 6 times of a maximum injection volume for said mold accumulated in a melted state.

2. A material supply and melting method for use in injection molding of molten metal and for supplying granular metal material from a supply apparatus into a cylindrical melting vessel, said vessel provided with: a weighing chamber communicating with a nozzle member in an extremity thereof; a rotatable agitation member inside and an injection means having an injection plunger, on the extremity portion thereof, inserted advanceably and retractably into a center portion of the agitation means, said injection plunger being slidably engaged with the weighing chamber, said method comprising the steps of:

melting the metal material by an external heat;

accumulating, weighing, then injecting and charging the metal material into a mold by said injection means to mold a metal article;

wherein the operation speed and time of said supply apparatus are controlled so that (1) the supply of said metal material during the molding operation and (2) the weighing of said metal are sequential, thereby maintaining the accumulation amount and temperature of molten metal in the melting vessel constant at all times.

3. The material supply and melting method in injection molding of melt material of claim 1; wherein said supply apparatus is controlled so that the supply of said metal material during the molding operation starts when the molten metal surface level is lowered to a lower limit of a predetermined level range, by monitoring and detecting a variation of the molten metal surface level by a liquid level sensor during an agitation operation of molten metal accumulated in the melting vessel by said agitation means, and stops when an upper limit is attained, thereby maintaining the accumulation amount and temperature of molten metal in the melting vessel constant at all times.

4. The material supply and melting method in injection molding of melt material of claim 2; wherein said said supply apparatus is controlled so that the supply of said metal material during the molding operation starts when the molten metal surface level is lowered to a lower limit of a predetermined level range, by monitoring and detecting a variation of the molten metal surface level by a liquid level sensor during an agitation operation of molten metal accumulated in the melting vessel by said agitation means, and stops when an upper limit is attained, thereby maintaining the accumulation amount and temperature of molten metal in the melting vessel constant at all times.

* * * * *

UNITED STATES PATENT AND TRADEMARK OFFICE

CERTIFICATE OF CORRECTION

PATENT NO. : 6,562,100 B2
DATED : May 13, 2003
INVENTOR(S) : Kiyoto Takizawa, et al.

It is certified that error appears in the above-identified patent and that said Letters Patent is hereby corrected as shown below:

Column 4,
Line 17, “lie” should read -- 11e --; and
Line 17, “lid” should read -- 11d --.

Signed and Sealed this

Thirty-first Day of August, 2004

JON W. DUDAS
*Director of the United States Patent and Trademark Office*